US009688078B1

(12) United States Patent
Irizarry et al.

(10) Patent No.: US 9,688,078 B1
(45) Date of Patent: Jun. 27, 2017

(54) METHOD AND APPARATUS FOR PRINTING ON A SPHERICAL OBJECT

(71) Applicant: Xerox Corporation, Norwalk, CT (US)

(72) Inventors: Roberto A. Irizarry, Rochester, NY (US); Carlos Manuel Terrero, Ontario, NY (US); Donald R. Fess, Rochester, NY (US); Brian Andrew Hanna, Webster, NY (US); Lynn C. Saxton, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/066,856

(22) Filed: Mar. 10, 2016

(51) Int. Cl.

| | |
|---|---|
| ***B41J 3/407*** | (2006.01) |
| ***B41M 1/40*** | (2006.01) |
| ***A63B 47/00*** | (2006.01) |
| ***B41F 17/30*** | (2006.01) |
| ***A63B 45/02*** | (2006.01) |
| *B41M 5/00* | (2006.01) |

(52) U.S. Cl.
CPC ..... *B41J 3/4073* (2013.01); *A63B 45/02* (2013.01); *A63B 47/00* (2013.01); *B41F 17/30* (2013.01); *B41M 1/40* (2013.01); *B41M 5/0082* (2013.01); *B41M 5/0088* (2013.01)

(58) Field of Classification Search
CPC ..... B41J 3/4073; B41M 5/0082; B41M 1/40; B41M 5/0088; B41M 5/0094; A63B 45/02; A63B 47/00; B41F 17/30
See application file for complete search history.

(56) References Cited

U.S. PATENT DOCUMENTS

| | | | | |
|---|---|---|---|---|
| 5,632,205 A * | 5/1997 | Gordon | B41F 17/30 101/483 |
| 6,923,115 B1 * | 8/2005 | Litscher | B41F 17/30 101/35 |
| 9,504,881 B2 * | 11/2016 | Hebert | A63B 45/02 |

* cited by examiner

*Primary Examiner* — Henok Legesse

(57) ABSTRACT

An apparatus, method and non-transitory computer readable medium for printing on a spherical object are disclosed. For example, the apparatus includes a print head, at least two wheels, wherein each one of the at least two wheels rotates around a single axis, at least one ball support coupled to a mechanical arm, wherein the at least one ball support rotates 360 degrees around and is positioned to secure the spherical object against the at least two wheels and a controller in communication with the print head and the at least two wheels to rotate the spherical object via the at least two wheels into a position to print via the print head.

18 Claims, 5 Drawing Sheets

METHOD AND APPARATUS FOR PRINTING ON A SPHERICAL OBJECT

The present disclosure relates generally to printing and, more particularly, to a method and apparatus for printing on a spherical object.

BACKGROUND

Current printing apparatuses allow for printing on cylindrical objects such as bottles and cans. For example, a path of rollers may be used to spin the cylindrical objects under a print head to print labels or text on the cylindrical objects.

Spherical objects present a challenge. Some printing apparatuses allow for printing on smaller spherical objects, such as golf balls, that use a suction arm and only provide a single axis of rotation. For example, the suction arm may rotate the golf ball around a single axis as an image or text is printed on the golf ball.

Another example of a printer for spherical objects is a Heidelberg Jetmaster. However, these printing apparatuses require 6 vector components to manipulate the print head around the spherical object. Having a large number of vector components leads to many mechanical parts and motors that can fail and additional complexity for motion quality, control scheme, and the like.

SUMMARY

According to aspects illustrated herein, there are provided an apparatus, method and non-transitory computer readable medium for printing on a spherical object. One disclosed feature of the embodiments is an apparatus that includes a print head, at least two wheels, wherein each one of the at least two wheels rotates around a single axis, at least one ball support coupled to a mechanical arm, wherein the at least one ball support rotates 360 degrees around and is positioned to secure the spherical object against the at least two wheels and a controller in communication with the print head and the at least two wheels to rotate the spherical object via the at least two wheels into a position to print via the print head.

Another disclosed feature of the embodiments is a method that includes receiving an image to be printed on to the spherical object, releasing at least one mechanical arm having a ball support that rotates 360 degrees around, detecting that the spherical object is positioned on at least two wheels, wherein each one of the two wheels rotates around a single axis, engaging the at least one mechanical arm having the ball support to secure the spherical object against the at least two wheels and rotating the at least two wheels to manipulate the spherical object to allow a fixed print head to print the image onto the spherical object.

Another disclosed feature of the embodiments is a non-transitory computer-readable medium having stored thereon a plurality of instructions, the plurality of instructions including instructions which, when executed by a processor, cause the processor to perform operations that receive an image to be printed on to the spherical object, release at least one mechanical arm having a ball support that rotates 360 degrees around, detect that the spherical object is positioned on at least two wheels, wherein each one of the two wheels rotates around a single axis, engage the at least one mechanical arm having the ball support to secure the spherical object against the at least two wheels and rotate the at least two wheels to manipulate the spherical object to allow a fixed print head to print the image onto the spherical object.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses an apparatus and method for printing on a spherical object. As discussed above, printing on spherical objects presents a challenge. Some printing apparatuses allow for printing on smaller spherical objects, such as golf balls, that use a suction arm and only provide a single axis of rotation. For example, the suction arm may rotate the golf ball around a single axis as an image or text is printed on the golf ball.

Another example of a printer for spherical objects is a Heidelberg Jetmaster. However, these printing apparatuses require 6 vector components to manipulate the print head around the spherical object. Having a large number of vector components leads to many mechanical parts and motors that can fail and additional complexity for motion quality, control scheme, and the like.

Embodiments of the present disclosure provide an apparatus that uses multiple wheels that can manipulate the spherical object in all directions. In other words, the wheels can rotate or move the spherical object in all 360 degrees. The apparatus can use a fixed print head while having the wheels rotate the spherical object using two vector components.

Figure 1:
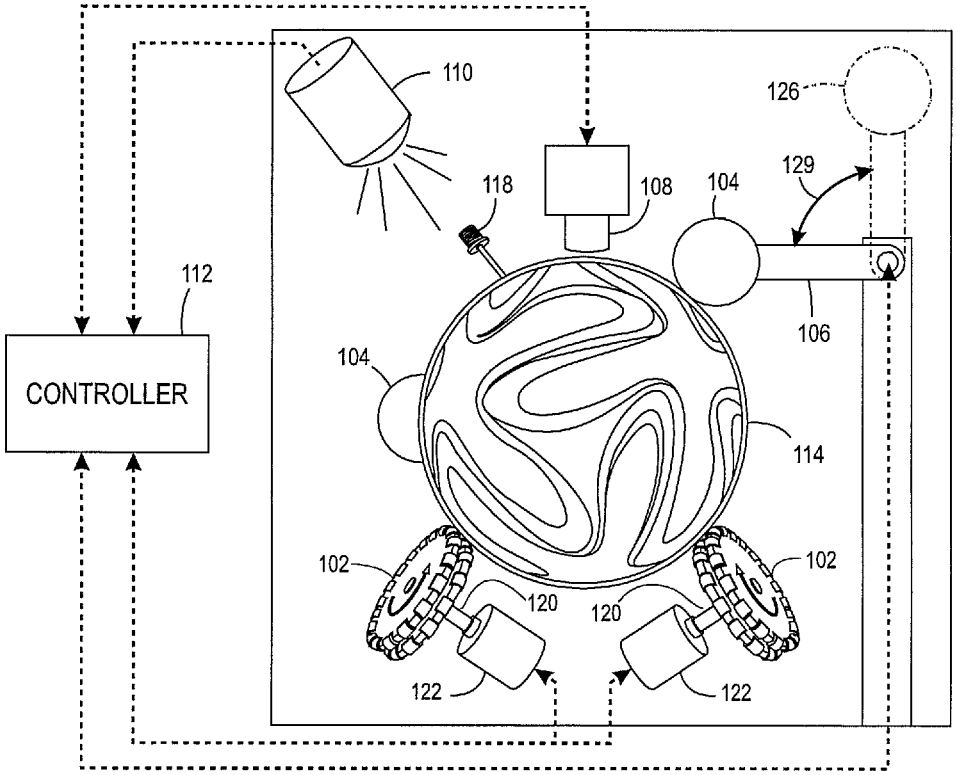
FIG. 1 illustrates a block diagram of an example apparatus of the present disclosure.

FIG. 1 illustrates an example apparatus 100 of the present disclosure. In one embodiment, the apparatus 100 may include at least two wheels 102, one or more ball supports 104 (also can be referred to as a spherical caster or a spherical support) coupled to a mechanical arm 106, a print head 108 and a registration module 110. In one embodiment, the wheels 102 may be angled towards one another and on opposite sides of a spherical object 114. The wheels 102 may be each coupled to an axle 120 that is then coupled to one or more motors 122.

In one embodiment, the ball supports 104 may rotate freely 360 degrees around on the mechanical arm 106. In one embodiment, the mechanical arm 106 may be spring loaded to pull the ball support 104 downward. As a result, when the spherical object 114 is placed onto the wheels 102, the ball support 104 may press down against the spherical object 114 to hold the spherical object 114 in position against the wheels 102. As a result, the spherical object 114 is kept in position by the ball support 104 while the wheels 102 manipulate, move or rotate the spherical object 114 during printing.

In one embodiment, the print head 108 may dispense a printing fluid onto the spherical object 114. For example, the printing fluid may be a print ink or any other fluid to mark a text, image, design, and the like, onto the spherical object 114.

In one embodiment, the registration module 110 may be used to detect an origin of the spherical object 114. For example, to ensure the image is mapped properly and printed properly onto the spherical object 114 an origin, or a starting point, may need to be identified. In one embodiment, the registration module 110 may include a video camera (e.g., a red, green, blue (RGB), black and white, infrared camera, and the like) to scan the spherical object 114 for a unique marker. For example, the marker may be a valve in a ball. In another embodiment, the spherical object 114 may be marked by a dot or some other subtle marking before being placed inside of the apparatus 100. The registration module 110 may detect the valve or the mark and set that point as the origin.

In another embodiment, the registration module 110 may be pressure sensitive or mechanical. For example, a needle 118 may be inserted into the valve to be detected by the registration module 110 based on a physical connection to the needle 118. The needle 118 may be detected as the origin for the spherical object 114.

In one embodiment, the apparatus 100 may also include a controller 112. The controller 112 may be deployed as a processor and non-transitory computer readable storage medium that stores instructions that are executed by the processor. In one embodiment, the controller 112 may receive a map of the spherical object 114 and an image (e.g., a text, a design, a graphic, a logo, a picture, and the like) that is to be printed onto the spherical object 114.

In one embodiment, the controller 112 may be in communication with, and control operation of, the motor 122, the mechanical arm 106, the print head 108 and the registration module 110. For example, after the controller 112 receives the map of the spherical object 114 and the image to be printed, the controller 112 may release the mechanical arm 106 such that the mechanical arm 106 is moved (as shown by an arrow 129) to an open position as shown by dashed lines 126. The mechanical arm 106 may be spring loaded or mechanically driven. In another embodiment, the mechanical arm 106 may be manually manipulated by an operator. In one embodiment, the print head 108 may be moved vertically up and down to provide more room for the spherical object 114 to be placed on the wheels 102 inside of the apparatus 100.

The spherical object 114 may be placed on the wheels 102. In one example, the registration module 110 may also be used to detect when the spherical object 114 has been placed on the wheels 102. In another embodiment, an operator may provide an input to the controller 112 that the spherical object 114 has been placed in the apparatus 100 and on the wheels 102.

When the spherical object 114 is detected as being on the wheels 102, the controller 112 may engage the mechanical arm 106 such that the ball support 104 presses against the spherical object 114. In another embodiment, an operator may manipulate the mechanical arm 106 into a closed position against the spherical object 114. The ball support 104 at the end of the mechanical arm 104 may be used to hold the spherical object 114 in place during printing. Although two ball supports 104 are illustrated in FIG. 1, it should be noted that any number of ball supports 104 (less or more) may be deployed in the apparatus 100.

The controller 112 may then operate the motor 122 to spin one or more of the wheels 102. As one or more of the wheels 102 rotate, the spherical object 114 may be rotated to allow the registration module 110 to locate the origin (e.g., a valve, a spot, a mark, the needle 118, and the like). Once the origin is detected, the controller 112 may then control the motor 122 and the print head 108 to print the image onto the spherical object 114. For example, operation of the print head 108 may include controlling when and how much printing fluid is dispensed.

The controller 112 may control operation of the wheels 102 to manipulate, rotate, spin, or move the spherical object 114 into a position to receive the printing fluid from the print head 108. In one example, the print head 108 may be fixed along an x-axis and a y-axis and the controller 112 may control the motor 122 to rotate one or more of the axis 120 and wheels 102. However, as noted above, the print head 108 may be moved vertically up and down to allow the print head to move closer to the spherical object 114 or out of the way when the spherical object 114 is being placed on the wheels 102 inside of the apparatus 100.

Notably, all 360 degrees of the spherical object 114 may be printed on by the print head 108 using only two vector components. For example, a first wheel 102 may spin in one direction and a second wheel 102 may spin in a second direction that is perpendicular to the direction of the first wheel 102. As a result, even if the print head 108 is in a fixed position, the spherical object 114 may be manipulated by the wheels 102 to print on any surface of the spherical object 114 in all directions 360 degrees around.

Figure 2:
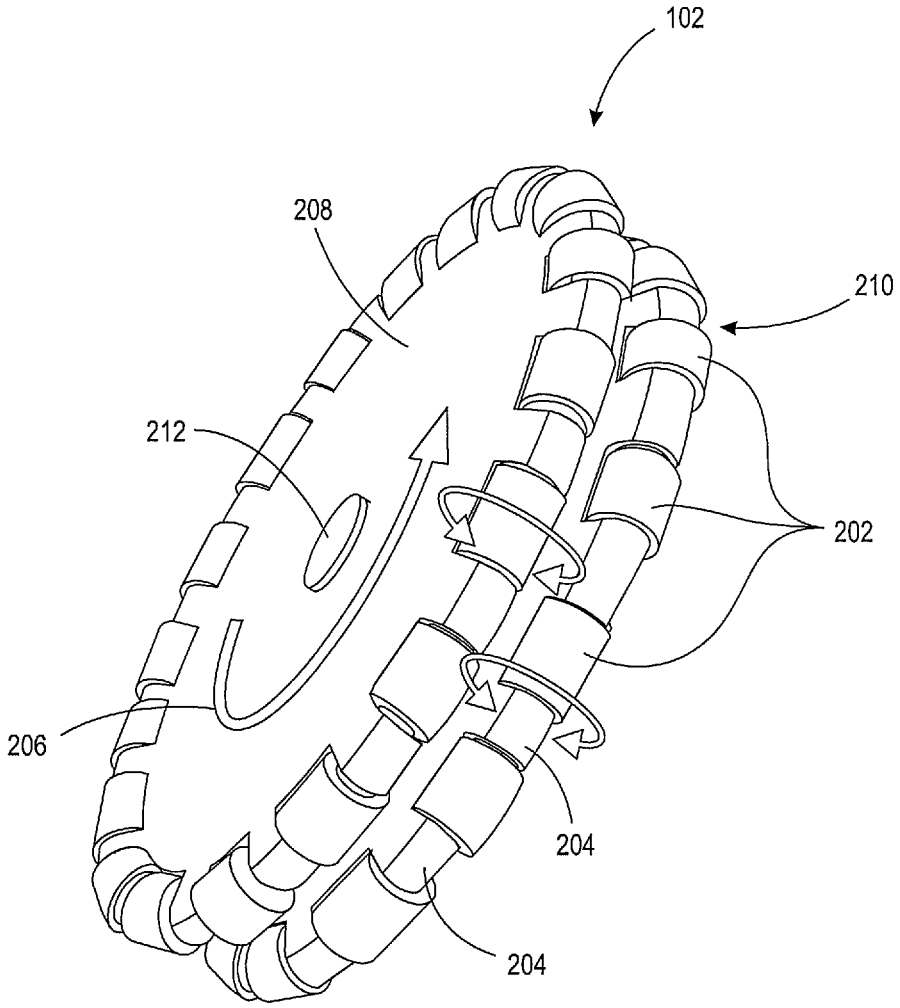
FIG. 2 illustrates an example wheel.

In one embodiment, the design of the wheels 102 may allow the spherical object 114 to be manipulated for two dimensional printing. FIG. 2 illustrates a more detailed view of the wheels 102.

In one embodiment, each wheel 102 may include a stack of two discs 208 and 210. Each disc 208 and 210 may include an opening 212 to be coupled to an axis, a rod, and the like that is then coupled to the motor 122.

In one embodiment, each wheel 102 may have a perimeter that is comprised of a plurality of cylindrical rollers 202 and a plurality of connectors 204. In one embodiment, the connectors 204 may be fabricated from a metal and be metal connectors. In one embodiment, the cylindrical rollers 202 may be fabricated as a plastic with a urethane coating. In another embodiment, the cylindrical rollers 202 may be fabricated from a rubber material.

In one embodiment, the perimeter, outside edge, or periphery of each wheel 102 may include an alternating series of cylindrical rollers 202 and connectors 204. In other words, the outer ring of each wheel 102 may be fabricated from a cylindrical roller 202 connected to a metal connector 204, which is then connected to another cylindrical roller 202, which is then connected to another metal connector 204, and so forth until the outer ring is completed.

In one embodiment, the discs 208 and 210 may be stacked such that the respective perimeter of the discs 208 and 210 are offset. In other words, each cylindrical roller 202 of the disc 208 would be adjacent to a connector 204 of the disc 210. In addition, each connector 204 of the disc 208 would be adjacent to a cylindrical roller 202 of the disc 210. Said another way, the discs 208 and 210 may be stacked in any offset configuration as long as the cylindrical roller 202 of the discs 208 and 210 are not aligned and the connectors 204 of the discs 208 and 210 are not aligned. The offset positioning of the discs 208 and 210 may ensure that at least one of the cylindrical rollers 202 are always in contact with the spherical object 114.

Figure 3:
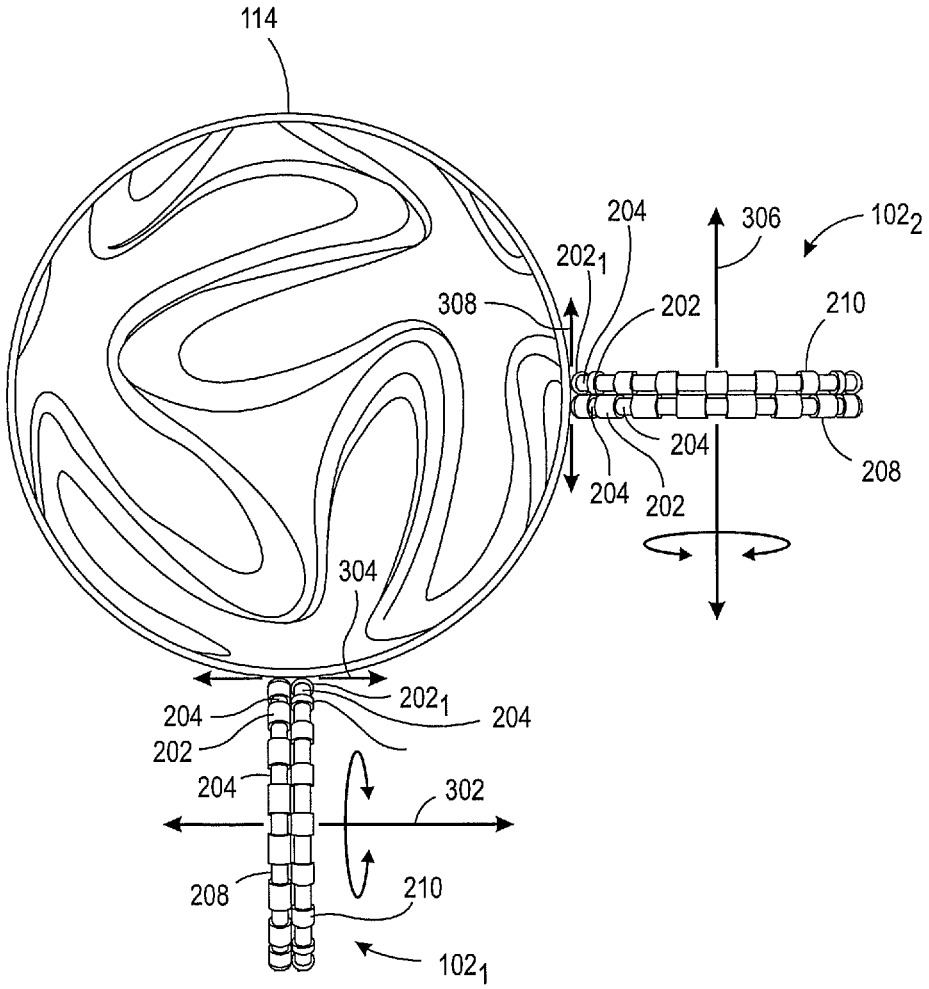
FIG. 3 illustrates an example block diagram of axis of rotation of the wheels.

In one embodiment, the cylindrical rollers 202 may be fabricated to "grip" the spherical object 114 when the wheel 102 is rotating. In addition, the cylindrical rollers 202 may be fabricated to rotate in a direction that is perpendicular to an axis of rotation of the opposing wheel 102 when the respective wheel 102 is stationary. FIG. 3 illustrates an example of this relationship.

FIG. 3 illustrates one example configuration of two wheels $\mathbf{102}_1$ and $\mathbf{102}_2$. In one embodiment, the wheel $\mathbf{102}_1$ may rotate around a single axis of rotation 302 and the wheel $\mathbf{102}_2$ may rotate around a single axis of rotation 306. Using these two axes of rotation 302 and 306, the spherical object 114 may be rotated, spun, moved, or manipulated into any position 360 degrees around.

In one embodiment, the cylindrical rollers 202 may be designed such that a cylindrical roller 202 that is in contact with the spherical object 114 may rotate around an axis that is perpendicular to the axis of rotation 302 or 306 of the respective wheel $\mathbf{102}_1$ and $\mathbf{102}_2$, respectively. For example, the axis of rotation of the cylindrical roller $\mathbf{202}_1$ of the disc 210 of the wheel $\mathbf{102}_1$ would go into the page and be perpendicular to the axis of rotation 302. Similarly, the axis of rotation of the cylindrical roller $\mathbf{202}_1$ of the disc 210 of the wheel $\mathbf{102}_2$ would go into the page and be perpendicular to the axis of rotation 306.

Described in another way, the cylindrical roller $\mathbf{202}_1$ of the disc 210 of the wheel $\mathbf{102}_1$ that is in contact with the spherical object 114 may rotate in a direction 304 that is perpendicular to the axis of rotation 306 of the wheel $\mathbf{102}_2$. Similarly, the cylindrical roller $\mathbf{202}_1$ of the disc 210 of the wheel $\mathbf{102}_2$ that is in contact with the spherical object 114 may rotate in a direction 308 that is perpendicular to the axis of rotation 302 of the wheel $\mathbf{102}_1$.

Described in yet another way, the cylindrical roller $\mathbf{202}_1$ of the disc 210 of the wheel $\mathbf{102}_1$ that is in contact with the spherical object 114 may rotate in a direction 304 that is parallel to the axis of rotation 302 of the wheel $\mathbf{102}_1$. Similarly, the cylindrical roller $\mathbf{202}_1$ of the disc 210 of the wheel $\mathbf{102}_2$ that is in contact with the spherical object 114 may rotate in a direction 308 that is parallel to the axis of rotation 306 of the wheel $\mathbf{102}_2$. As a result, the design of the wheels $\mathbf{102}_1$ and $\mathbf{102}_2$ allow the spherical object 114 to be manipulated in any direction 360 degrees around.

It should be noted that FIG. 3 illustrates one example positioning of the wheels $\mathbf{102}_1$ and $\mathbf{102}_2$. However, the wheels $\mathbf{102}_1$ and $\mathbf{102}_2$ may be positioned anywhere around the spherical object 114 as long as the wheels $\mathbf{102}_1$ and $\mathbf{102}_2$ can support the spherical object 114 and maintain the relationships relative to one another described above.

It should be noted that the features of FIGS. 1-3 are not necessarily drawn to scale. For example, some features such as the wheels 102 may be drawn to be larger to illustrate the details of the wheels 102. For example, the wheels 102 may be one half to one third smaller relative to the spherical object 114.

Figure 4:
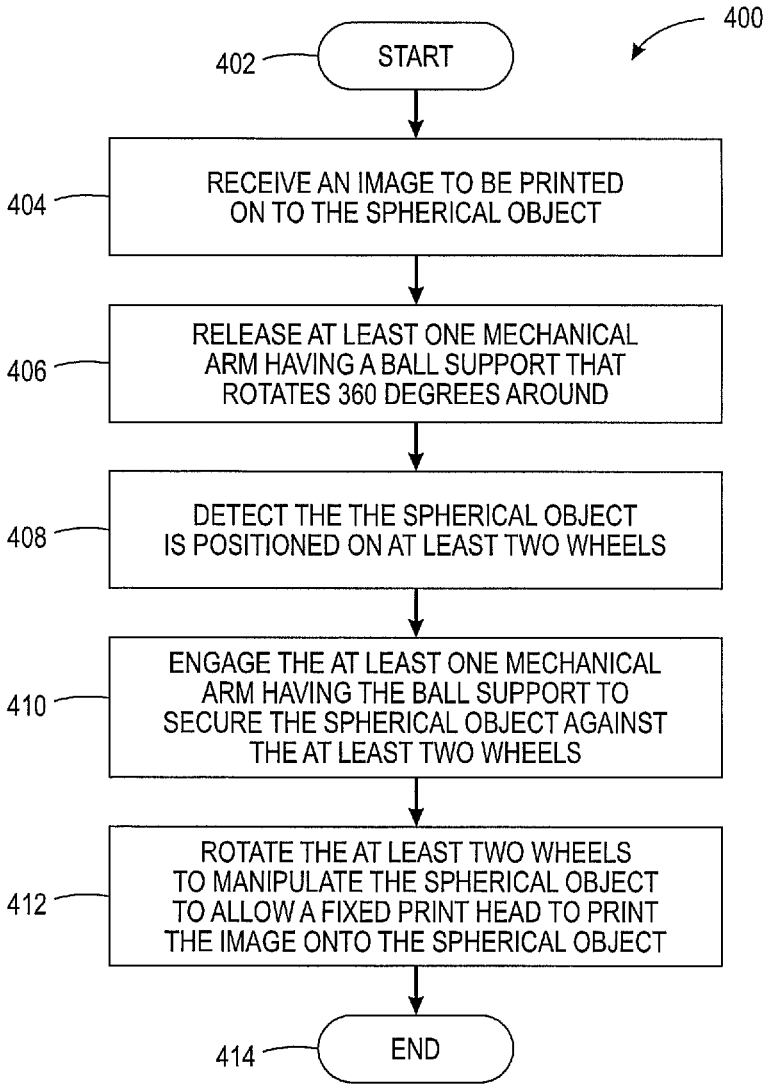
FIG. 4 illustrates a flowchart of an example method for printing on a spherical object.
Figure 5:
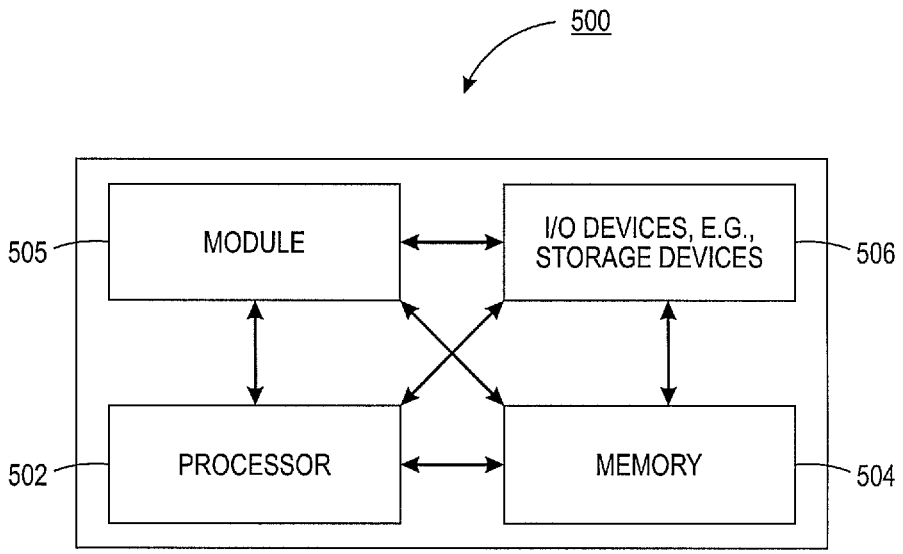
FIG. 5 illustrates an example high-level block diagram of a computer suitable for use in performing the functions described herein.

FIG. 4 illustrates a flowchart of an example method 400 for printing on a spherical object. In one embodiment, one or more steps or operations of the method 400 may be performed by the apparatus 100 (e.g., the controller 112) and/or a computer as illustrated in FIG. 5 and discussed below.

At block 402, the method 400 begins. At block 404, the method 400 receives an image to be printed on to the spherical object. For example, a graphical illustration tool, computer aided drawing (CAD) tool, and the like may be used to design an image (e.g., a text, a graphic, a design, a logo, a picture, and the like) to be printed two-dimensionally onto the spherical object. The image may be received by a controller of the apparatus used to print on the spherical object.

In one embodiment, a mapping of the spherical object may also be received. The image may be mapped onto the spherical object based on an origin or a starting point. The spherical object may be scanned to detect the origin such that the image may be aligned onto the spherical object in accordance with the mapping.

At block 406, the method 400 releases at least one mechanical arm having a ball support that rotates 360 degrees around. For example, the mechanical arm may be moved into an open position such that the mechanical arm is out of the way. In one embodiment, the print head may also be moved vertically upwards to allow for more space depending on a size of the spherical object.

At block 408, the method 400 detects that the spherical object is positioned on at least two wheels. For example, an operator may place the spherical object onto the at least two wheels. A sensor (e.g., the registration module, described above) may detect that the spherical object has been positioned onto the at least two wheels. In another embodiment, the detection may be based on an input received from the operator. For example, a button may be pressed sending a signal to the controller that the spherical object is in position and ready for printing.

At block 410, the method 400 engages the at least one mechanical arm having the ball support to secure the spherical object against the at least two wheels. For example, the mechanical arm may be spring loaded or have a mechanical drive that is controlled by the controller. The mechanical arm may be moved into a closed position such that the ball support on the end of the mechanical arm rests against the spherical object. In one embodiment, the force of the spring loaded arm or the mechanical drive may press the spherical object against the two wheels with enough force, or pressure, to ensure that the spherical object is secure during printing.

In one embodiment, the use of the spring loaded mechanical arm or the mechanical drive allows a variety of different sized spherical objects to be printed. For example, the movement of the mechanical arm may be flexible enough to adjust to any sized spherical object.

At block 412, the method 400 rotates the at least two wheels to manipulate the spherical object to allow a fixed print head to print the image onto the spherical object. Once the spherical object is secured, the controller may control the at least two wheels via a motor coupled to the wheels. For example, the controller may rotate one or more of the wheels to rotate, manipulate, spin, or move the spherical object into various different positions to print the image onto the spherical object.

In one embodiment, the spherical object may be manipulated such that the at least two wheels and the ball support do not touch ink that has recently been printed to prevent smearing. For example, the controller may know which images have been recently printed and the location of the positioning of the spherical object on the wheels based on the origin that was identified. In one embodiment, a condition may be set such that the wheels do not go over a recently printed image until time, t, has elapsed (e.g., in seconds).

In one embodiment, after the printing has completed the mechanical arm may be disengaged again and the spherical object may be removed. In one embodiment, the spherical object may be kept inside the apparatus for a predefined amount of time (e.g., 1 minute, 1 hour, and the like) to allow the printing fluid to dry before the spherical object is handled to prevent smearing. At block 414, the method 400 ends.

It should be noted that although not explicitly specified, one or more steps, functions, or operations of the method 400 described above may include a storing, displaying and/or outputting step as required for a particular application. In other words, any data, records, fields, and/or intermediate results discussed in the methods can be stored, displayed, and/or outputted to another device as required for a particular application. Furthermore, steps, functions, or operations in FIG. 4 that recite a determining operation, or involve a decision, do not necessarily require that both branches of the determining operation be practiced. In other words, one of the branches of the determining operation can be deemed as an optional step.

FIG. 5 depicts a high-level block diagram of a computer that can be transformed to into a machine that is dedicated to perform the functions described herein. As a result, the embodiments of the present disclosure improve the operation and functioning of the computer to improve shaping data traffic in a LAN, as disclosed herein.

As depicted in FIG. 5, the computer 500 comprises one or more hardware processor elements 502 (e.g., a central processing unit (CPU), a microprocessor, or a multi-core processor), a memory 504, e.g., random access memory (RAM) and/or read only memory (ROM), a module 505 for printing on a spherical object, and various input/output devices 506 (e.g., storage devices, including but not limited to, a tape drive, a floppy drive, a hard disc drive or a compact disc drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 505 for printing on a spherical object (e.g., a software program comprising computer-executable instructions) can be loaded into memory 504 and executed by hardware processor element 502 to implement the steps, functions or operations as discussed above in connection with the example method 400. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 505 for printing on a spherical object (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for printing on a spherical object, comprising:

a print head;

at least two wheels, wherein each one of the at least two wheels rotates around a single axis, wherein the at least two wheels each comprises a stack of two discs, wherein a perimeter of each one of the two discs comprises a plurality of cylindrical rollers and a plurality of connectors, wherein the plurality of cylindrical rollers and the plurality of connectors are arranged in an alternating series of a cylindrical roller and a connector;

at least one ball support coupled to a mechanical arm, wherein the at least one ball support rotates 360 degrees around and is positioned to secure the spherical object against the at least two wheels; and a controller in communication with the print head and the at least two wheels to rotate the spherical object via the at least two wheels into a position to print via the print head.

2. The apparatus of claim 1, wherein the print head is in a fixed position along an x-axis and a y-axis.

3. The apparatus of claim 1, wherein the single axis of the each one of the at least two wheels is positioned at different angles.

4. The apparatus of claim 1, wherein the at least two wheels are rotatable to position any surface of the spherical object towards the print head to receive a printing fluid.

5. The apparatus of claim 1, wherein the two discs are arranged such that the perimeter of the alternating series of cylindrical roller and the connector of a first disc of the two discs is offset from the perimeter of the alternating series of cylindrical roller and the connector of a second disc of the two discs.

6. The apparatus of claim 1, wherein the cylindrical rollers rotate along an axis that is perpendicular to an axis of rotation of a respective wheel.

7. The apparatus of claim 1, wherein the cylindrical roller of a first wheel of the at least two wheels in contact with the spherical object rotates in a direction that is perpendicular to the single axis of rotation of a second wheel of the at least two wheels.

8. The apparatus of claim 1, wherein the cylindrical roller of a first wheel of the at least two wheels in contact with the spherical object rotates in a direction that is parallel to the single axis that a first wheel of the at least two wheels rotates around.

9. The apparatus of claim 1, wherein the cylindrical rollers comprise a plastic with a urethane coating.

10. The apparatus of claim 1, wherein the cylindrical rollers comprise a rubber material.

11. The apparatus of claim 1, wherein the mechanical arm is spring loaded.

12. The apparatus of claim 1, further comprising;

a registration module that scans the spherical object to detect an origin for mapping the spherical object.

13. A method for printing on a spherical object, comprising:

receiving an image to be printed on to the spherical object;

releasing at least one mechanical arm having a ball support that rotates 360 degrees around;

detecting that the spherical object is positioned on at least two wheels, wherein each one of the at least two wheels rotates around a single axis, wherein the at least two wheels each comprises a stack of two discs, wherein a perimeter of each one of the two discs comprises a plurality of cylindrical rollers and a plurality of connectors, wherein the plurality of cylindrical rollers and the plurality of connectors are arranged in an alternating series of a cylindrical roller and a connector;

engaging the at least one mechanical arm having the ball support to secure the spherical object against the at least two wheels; and rotating the at least two wheels to manipulate the spherical object to allow a fixed print head to print the image onto the spherical object.

14. The method of claim 13, further comprising:

detecting an origin for mapping the spherical object to print the image.

15. The method of claim 14, wherein the detecting comprises inserting a needle into a valve of the spherical object.

16. The method of claim 13, wherein the rotating the at least two wheels comprises:

rotating a first wheel of the at least two wheels while a second wheel of the at least two wheels remains stationary, wherein the cylindrical roller in contact with the spherical object rotates in a direction of rotation of the first wheel.

17. An apparatus for printing on a spherical object, comprising:

a print head;

at least two wheels, wherein each one of the at least two wheels rotates around a single axis, wherein the at least two wheels each comprises a stack of two discs, wherein a perimeter of each one of the two discs comprises a plurality of cylindrical rollers and a plurality of metal connectors, wherein the plurality of cylindrical rollers and the plurality of metal connectors are arranged in an alternating series of a cylindrical roller and a metal connector such that the plurality of cylindrical rollers of a first disc of the stack of two discs is adjacent to the plurality of metal connectors of a second disc of the stack of two discs and the plurality of metal connectors of the first disc of the stack of two discs is adjacent to the plurality of cylindrical rollers of the second disc of the stack of two discs;

at least one ball support coupled to a mechanical arm positioned above the at least two wheels, wherein the at least one ball support rotates 360 degrees around and is positioned to secure the spherical object against the at least two wheels; and a controller in communication with the print head and at least one motor coupled to the at least two wheels, wherein the controller moves the spherical object into a position to print an image onto the spherical object via the print head, wherein the spherical object is moved with the at least two wheels via operation of the at least one motor.

18. The apparatus of claim 17, further comprising;

a registration module that scans the spherical object to detect an origin for mapping the spherical object.

* * * * *